US005489412A

United States Patent [19]

Yoshioka et al.

[11] Patent Number: 5,489,412

[45] Date of Patent: Feb. 6, 1996

[54] ELECTRODE MATERIAL

[75] Inventors: Nobuyuki Yoshioka; Yasushi Noda; Toshimasa Fukai; Nobutaka Suzuki, all of Tokyo, Japan

[73] Assignee: Kabushiki Kaisha Meidensha, Tokyo, Japan

[21] Appl. No.: 233,887

[22] Filed: Apr. 26, 1994

[30] Foreign Application Priority Data

Apr. 30, 1993 [JP] Japan ..... 5-104003
Jun. 23, 1993 [JP] Japan ..... 5-151747

[51] Int. Cl.[6] ..... C22F 1/14; H01B 1/02; H01H 33/66

[52] U.S. Cl. ..... 419/23; 419/38; 419/47

[58] Field of Search ..... 420/501; 200/265, 200/266; 428/559, 567, 539.5; 75/247; 409/23, 38, 47

[56] References Cited

U.S. PATENT DOCUMENTS

| | | | |
|---|---|---|---|
| 4,008,081 | 2/1977 | Hundstad | 420/495 |
| 4,048,117 | 9/1977 | Emmerich | 252/513 |
| 4,190,753 | 2/1980 | Gainer | 200/144 B |
| 4,810,289 | 3/1989 | Hoyer et al. | 75/232 |

FOREIGN PATENT DOCUMENTS

| | | |
|---|---|---|
| 0076659 | 4/1983 | European Pat. Off. . |
| 2392481 | 12/1978 | France . |
| 3729033 | 3/1988 | Germany . |
| 54-026220 | 4/1979 | Japan . |
| 1086424 | 7/1989 | Japan . |

OTHER PUBLICATIONS

U.S. patent application Ser. No. 07/738,189 for Electrode Contact Material, by Yasushi Noda et al., Filed Jul. 30, 1991.

U.S. patent application Ser. No. 07/965,203 for Process For Forming Contact Material, by Nobuyuki Yoshioka et al., Filed Oct. 23, 1992.

*Primary Examiner*—Donald P. Walsh
*Assistant Examiner*—Anthony R. Chi
*Attorney, Agent, or Firm*—Bachman & LaPointe

[57] ABSTRACT

A process for forming an electrode assembled into a vacuum interrupter is composed of the steps of blending silver(Ag) powder and chromium(Cr) powder in a content ratio such that Ag powder forms a matrix and Cr powder being dispersed therein, the blending ratio is prefer to be determined to contain 50 to 95 wt. % of Ag powder and 5 to 50 wt. % of Cr powder, compacting the blended powder to a compacted body, sintering the body at temperatures around melting point of Ag, and regulating density of the sintered article at least 90%. Particle size of Cr to be blended may be determined less than 150 μm, more preferably, less than 60 μm. Sintering temperature may be determined between 800° to 950° C.

8 Claims, 10 Drawing Sheets

CROSS-SECTIONAL SURFACE
OF Cu-20% Cr ATOMIZED ELECTRODE
(AFTER LARGE CURRENT BREAKING)

0.2mm
× 100

0.2mm
× 100

× 100

× 100

× 100

PARTICLE SIZE OF Cr-10 μm (× 100)

PARTICLE SIZE OF Cr-100 μm (× 100)

CROSS-SECTIONAL SURFACE
OF Cu-20% Cr ATOMIZED ELECTRODE
(AFTER LARGE CURRENT BREAKING)

ELECTRODE MATERIAL

BACKGROUND OF THE INVENTION

1. Field of the Invention

The present invention relates generally to an electrode material to be assembled into a-vacuum interrupter. Specifically, the present invention relates to such material composed of silver (Ag) and chromium (Cr) with low contact resistance and excellent breaking ability.

2. Description of the Background Art

Conventionally, copper(Cu)-bismuth(Bi) alloy is utilized for an electrode material of a vacuum interrupter. Such electrode material made of Cu-Bi generally contains less than 1 wt. % of Bi against the amount of Cu, which is a basis metal, to increase welding proof of the material. Cu-Bi alloy has low contact resistance appropriate for electrodes which can provide large current. However, the material has certain problem in voltage resistance and breaking ability thereof.

Copper(Cu)-chromium(Cr) alloy in which Cr particles dispersing in a Cu matrix is also utilized for the material for the aforementioned usage because of superior voltage resistance and breaking ability thereof to Cu-Bi alloy. However, contact resistance of the alloy is relatively higher than that of Cu-Bi alloy, specifically, contact resistance significantly increases when current is broken.

In addition, electrode materials containing silver(Ag) is also known in the art, however, breaking ability thereof is inferior to that of Cu-Cr alloy or Cu-Bi alloy. Therefore, application of Ag containing material is limited as Ag-WC alloy for switches which are not frequently suffered from current breaking.

Recently, according to improvement of the vacuum interrupter, electrode materials with low contact resistance having superior voltage resistance and breaking ability to those of materials made of Cu-Bi alloy are more and more required for the electrode which can provide large amount of current.

SUMMARY OF THE INVENTION

It is therefore a principal object of the present invention to provide an electrode material which is assembled into a vacuum interrupter having low contact resistance and excellent voltage resistance with high breaking ability.

In order to accomplish the aforementioned and other objects, a process for forming an electrode is composed of the steps of blending silver(Ag) powder and chromium(Cr) powder in a content ratio such that Ag powder forms a matrix and Cr powder being dispersed therein, compacting the blended powder to a compacted body, sintering the body at temperatures around melting point of Ag, and regulating density of the sintered article at least 90%.

Ag powder may be contained between 50 to 95 wt. % and Cr powder may be contained between 5 to 50 wt. % in the blended powder.

Particle size of the Cr powder to be blended may be less than 150 μ m, more preferably, less than 60 μm.

The temperature for sintering may be determined between 800° to 950° C.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

In the present invention, silver(Ag) powder, which is considered to promote reduction of contact resistance of electrodes, was utilized in variable compositions in the form of Ag-Cr electrodes. As a process for forming the electrodes, powder metallurgy, i.e., compacting and forming metallic powder then sintering, was used. The process utilizing powder metallurgy has been known in the art as that which can reduce manufacturing cost (refer to Japanese Patent First Publication (not allowed) No. 53-149676).

EXAMPLE 1

Chromium(Cr) powder having particle size of less than 150 μm and Ag powder having that of less than 80 μm were blended in variable ratios as shown in Table 1. The blended powder was filled into a die and compacted under the pressure of 3.5 ton/cm$^2$. Then, the compacted body was heated to sinter under vacuum condition ($5\times10^{-5}$ Torr) at 950° C., which is a temperature around melting point of Ag, for 2 hours to obtain an ingot for an electrode. Density of each ingot obtained is also shown in Table 1. As a comparison, 20% Cr-80% Cu was prepared by a process similar to that of the aforementioned. Table 1 shows conductivity of each compacted body when utilized as the electrode and density ratio thereof.

TABLE 1

| No. | Composition wt % Ag | Cr | Conductivity IACS % | Density Ratio % |
|---|---|---|---|---|
| 1 | 95 | 5 | 97 | 99 |
| 2 | 90 | 10 | 85 | 99 |
| 3 | 80 | 20 | 70 | 97 |
| 4 | 70 | 30 | 55 | 95 |
| 5 | 60 | 40 | 45 | 94 |
| 6 | 50 | 50 | 35 | 91 |
| 7 | 20Cr—80Cu | | 50 | 95 |

According to microphotographic observation of each ingot, Cr particles were evenly dispersed in a Ag matrix.

Figure 1:
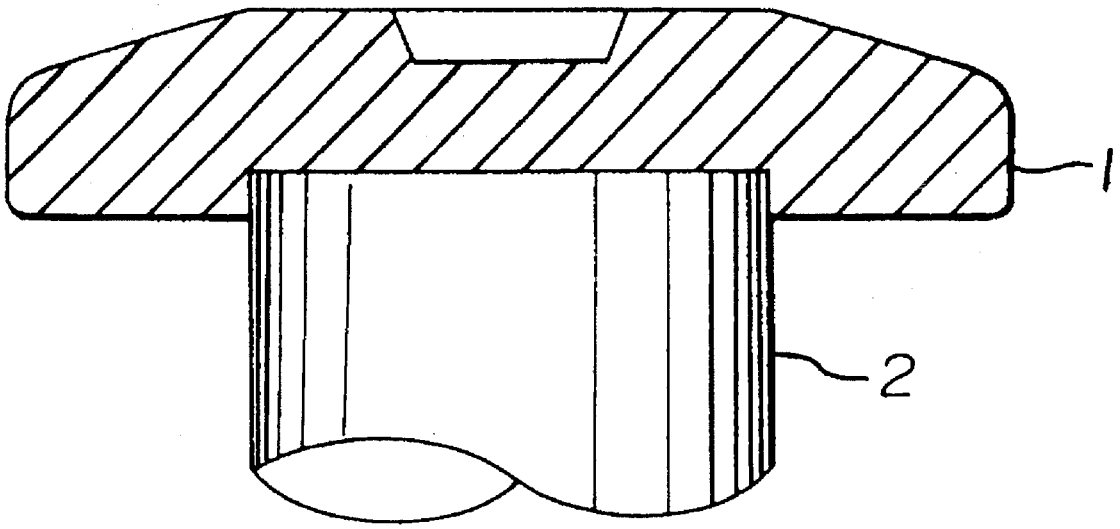
FIG. 1 is a schematic cross-sectional view showing a structure of an electrode.
Figure 2:
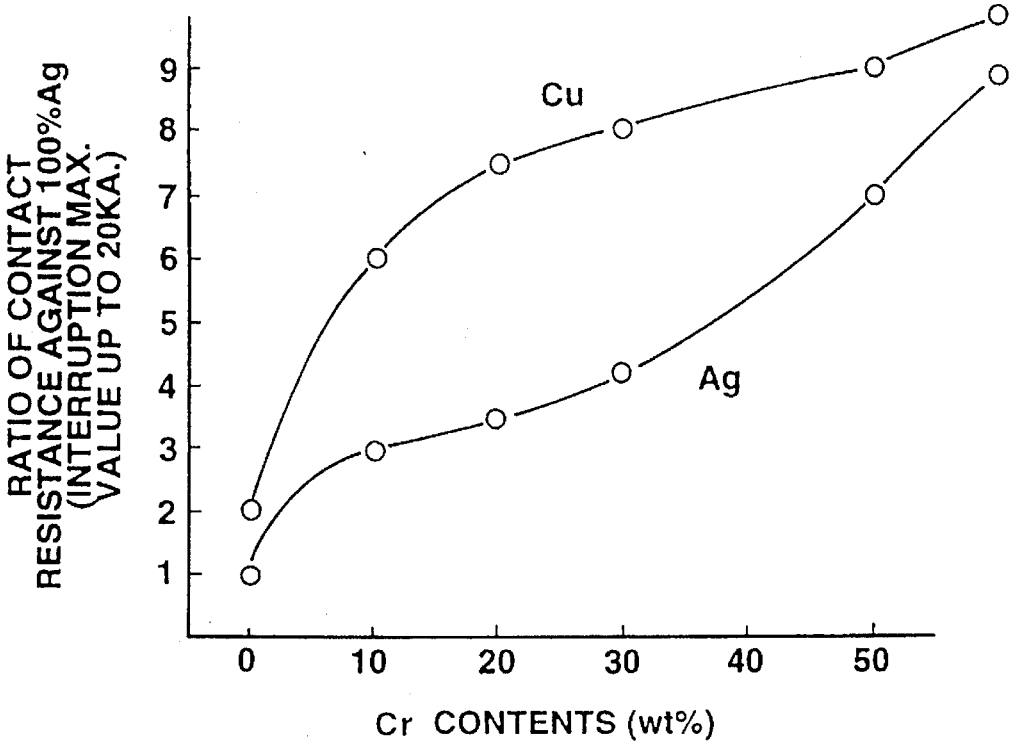
FIG. 2 is a graph showing a relationship between Cr contents and contact resistance of Ag-Cr and Cu-Cr electrodes.

The ingot was formed into an electrode, then assembled into an vacuum interrupter to measure contact resistance of the electrode (refer to FIG. 1, wherein numeral 1 designates an electrode and numeral 2 designates a lead). Contact resistances of each electrode are shown in FIG. 2 with that of Cu-Cr electrode as a comparison. In the figure, maximum values of contact resistances during current breaking until 20 KA are plotted. Contact resistance of Ag-Cr electrodes were effectively reduced compared to that of the Cu-Cr electrode.

Figure 3:
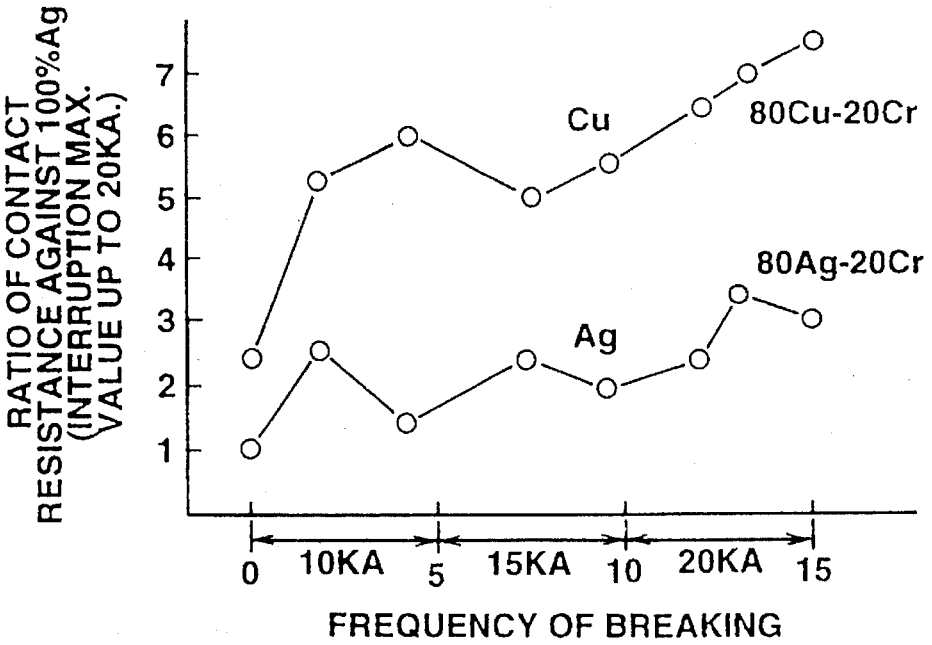
FIG. 3 is a graph showing a relationship between breaking frequency and contact resistance of Ag-Cr and Cu-Cr electrodes.

FIG. 3 shows a relationship between breaking frequency and contact resistance of the 80 wt. % Ag-20 wt. % Cr electrode and the 80 wt. % Cu-20 wt. % Cr electrode. Breaking test was done under the conditions shown in the horizontal axis of the figure. Referring to FIG. 3, the electrode of 80 wt. % Ag-20 wt. % Cr shows significantly lower contact resistance than that of the comparison(i.e., 80 wt. % Cu-20 wt. % Cr electrode) even though electric current was repeatedly broken.

Figure 4:
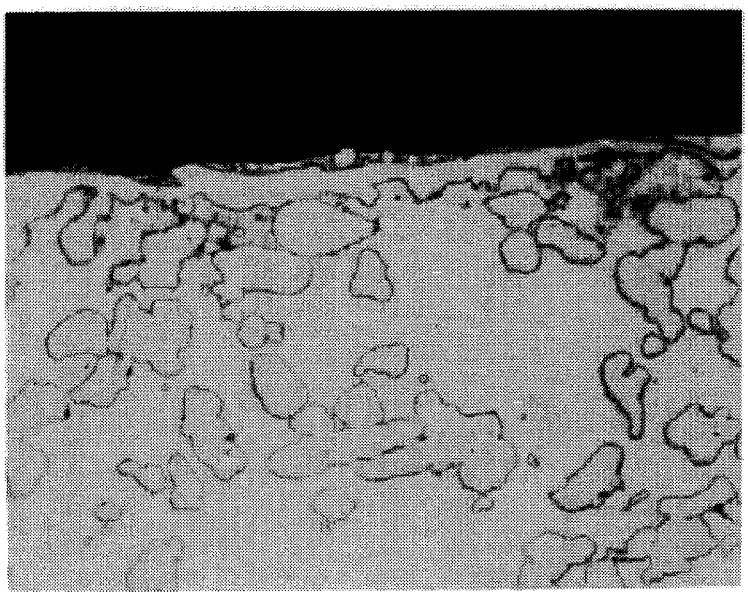
FIG. 4 is a photograph showing a cross-sectional metallic structure of an 80 wt. % Ag-20 wt. % Cr electrode after current breaking.
Figure 5:
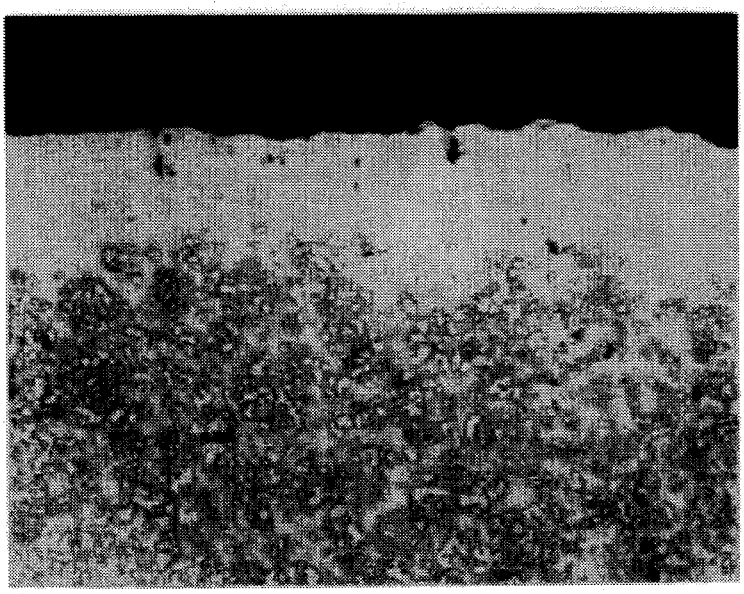
FIG. 5 is a photograph showing a cross-sectional metallic structure of an 80 wt. % Cu-20 wt. % Cr electrode after current breaking.

FIG. 4 shows a metallic structure of the electrode of 80 wt. % Ag-20 wt. % Cr after current breaking, and FIG. 5 shows that of the electrode of 80 wt. % Cu-20 wt. % Cr. Both are microscopic photographs. As shown in FIG. 5, the surface of the Cu-Cr electrode is covered with a molten layer A having metallic structure where less than 0.5 μm particle size of Cr particles being evenly dispersed. This seems to be derived from immediate cooling of an even liquid phase containing Cu and Cr which is formed when the electrode is molten by current breaking energy. Therefore, the electrode surface shows good hardness due to even dispersion of Cr. This causes increase of contact resistance of the electrode. On the other hand, the electrode of Ag-Cr, as shown in FIG. 4, has no layer showing distinct dispersion of Cr particles, though a molten layer A is shown adjacent the electrode surface. Cr particles and Ag matrix are unevenly located. Therefore, increase of contact resistance of the Ag-Cr electrode can be reduced.

Accordingly, Ag-Cr alloy is preferred for an electrode having lower contact resistance. Additionally, from Table 1 and FIGS. 2 and 3, 50 to 95 wt. % contents of Ag and 5 to 50 wt. % contents of Cr are preferred.

EXAMPLE 2

Ag powder having particle size of less than 80 μm and Cr powder having that of less than 150 μm were blended in various content ratios shown in Table 2.

TABLE 2

| No. | Composition wt % Ag | Cr | Conductivity IACS % | Density Ratio % |
|---|---|---|---|---|
| 1 | 95 | 5 | 97 | 99 |
| 2 | 90 | 10 | 85 | 99 |
| 3 | 85 | 15 | 80 | 98 |
| 4 | 80 | 20 | 70 | 97 |
| 5 | 70 | 30 | 55 | 95 |
| 6 | 60 | 40 | 45 | 94 |
| 7 | 50 | 50 | 35 | 91 |

Then, the blended powder was filled in a die, pressed under 3.5 ton/cm$^2$ to obtain a compacted body having 85 mm of diameter. The obtained bodies were formed into ingots for electrodes by the similar process under the similar conditions to the above-mentioned example 1. Conductivity and Density ratio of each ingots are also shown in Table 2.

Figure 6:
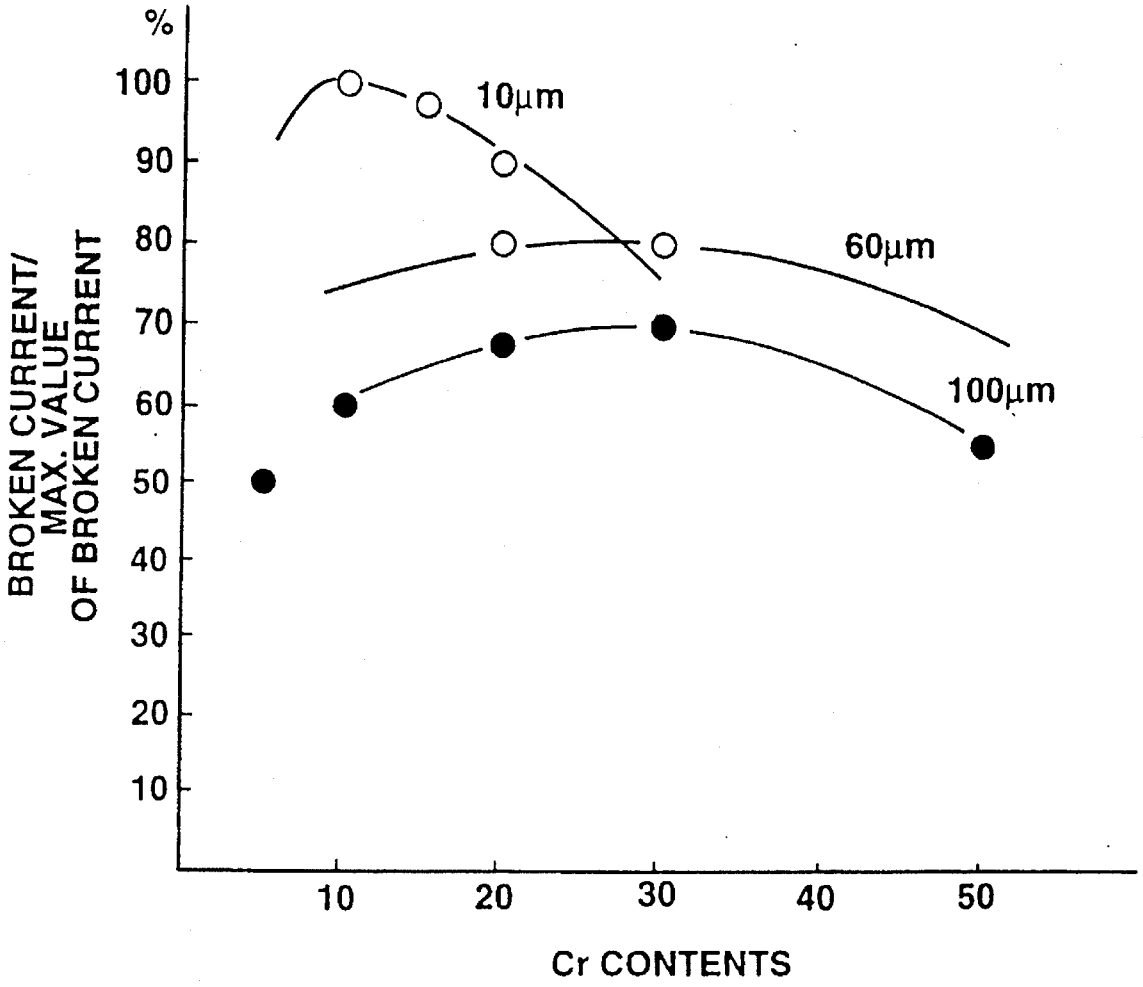
FIG. 6 is a graph showing a relationship between Cr contents and breaking current of the electrode.
Figure 7:
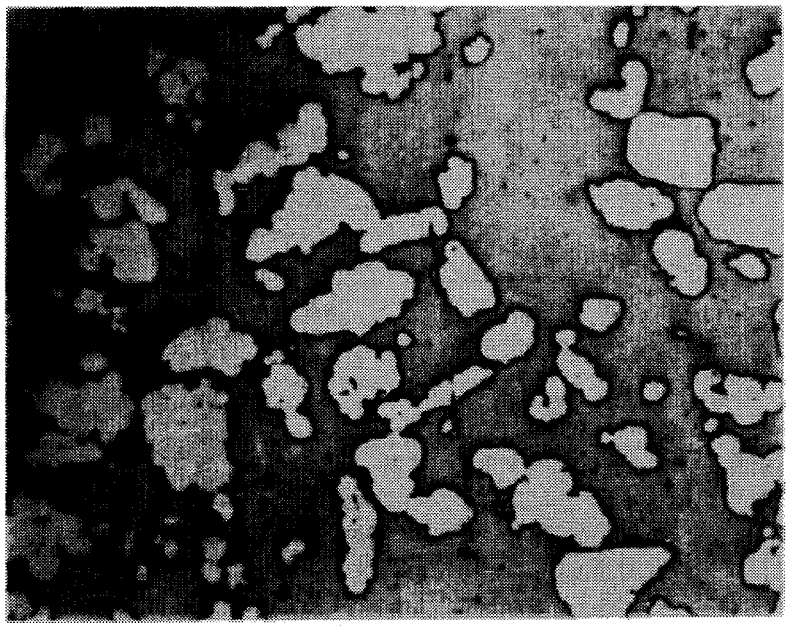
FIG. 7 is a photograph showing a cross-sectional metallic structure of a Ag-Cr electrode containing 100 μm particle size of Cr after sintering.

Then, each ingot was formed in an electrode having a spiral configuration of 80 mm diameter and assembled into a vacuum interrupter to measure current breaking ability thereof. Results are shown in FIG. 6 (a curve indicated by 100 μm). Contact resistance of the electrode of Ag-Cr shows lesser increase compared to that of the Cu-Cr electrode even though current breaking is repeatedly performed. FIG. 7 is a microphotograph showing metallic structure of the electrode of the present example.

EXAMPLE 3

Ag powder having particle size of less than 80 μm and Cr powder having that of less than 60 μm were blended in various content ratios shown in Table 3.

TABLE 3

| No. | Composition wt % Ag | Cr | Conductivity IACS % | Density Ratio % |
|---|---|---|---|---|
| 1 | 95 | 5 | 94 | 98 |
| 2 | 90 | 10 | 80 | 97 |
| 3 | 85 | 15 | 75 | 97 |
| 4 | 80 | 20 | 62 | 95 |
| 5 | 70 | 30 | 48 | 92 |
| 6 | 60 | 40 | 45 | 94 |

Then, the blended powder was filled in a die, pressed under 3.5 ton/cm$^2$ to obtain a compacted body having 85 mm of diameter. The obtained bodies were formed into ingots for electrodes by the similar process under the similar conditions to the above-mentioned example 1. Conductivity and Density ratio of each ingots are also shown in Table 3.

Figure 8:
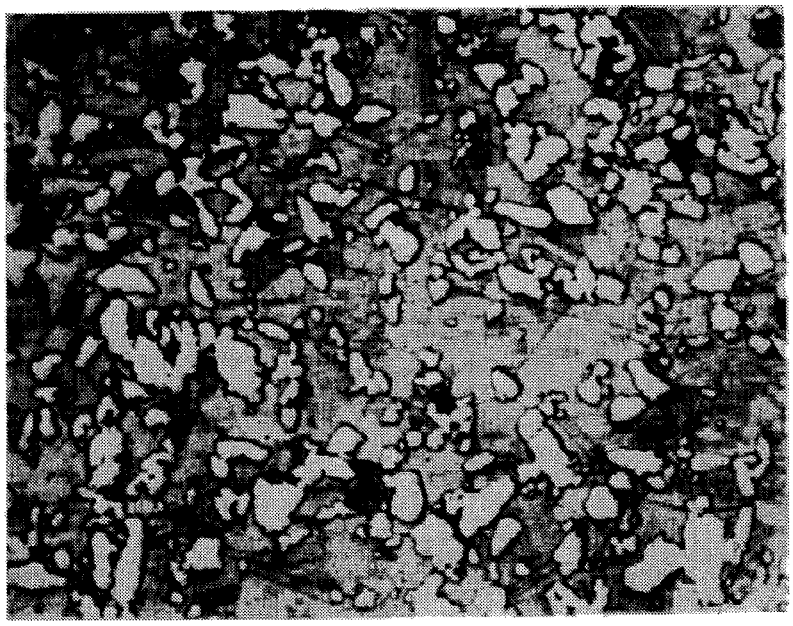
FIG. 8 is a photograph showing a cross-sectional metallic structure of a Ag-Cr electrode containing 60 μm particle size of Cr after sintering.

Then, electrodes were made by the similar process under the similar conditions to the above-mentioned example 2. Results are shown in FIG. 6 (a curve indicated by 60 μm). Contact resistance of the electrodes of Ag-Cr shows lesser increase compared to that of the Cu-Cr electrode even though current breaking is repeatedly performed. FIG. 8 is a microphotograph showing metallic structure of the electrode of the present example.

EXAMPLE 4

Ag powder having particle size of less than 80 μm and Cr powder having that of less than 10 μm were blended in various content ratios shown in Table 4.

TABLE 4

| No. | Composition wt % Ag | Cr | Conductivity IACS % | Density Ratio % |
|---|---|---|---|---|
| 1 | 95 | 5 | 92 | 96 |
| 2 | 90 | 10 | 78 | 95 |
| 3 | 85 | 15 | 65 | 90 |
| 4 | 80 | 20 | 50 | 87 |
| 5 | 70 | 30 | 45 | 85 |

Then, the blended powder was filled in a die, pressed under 3.5 ton/cm$^2$ to obtain a compacted body having 85 mm of diameter. The obtained bodies were formed into ingots for electrodes by the similar process under the similar conditions to the above-mentioned example 1. Conductivity and Density ratio of each ingots are also shown in Table 4.

Figure 9:
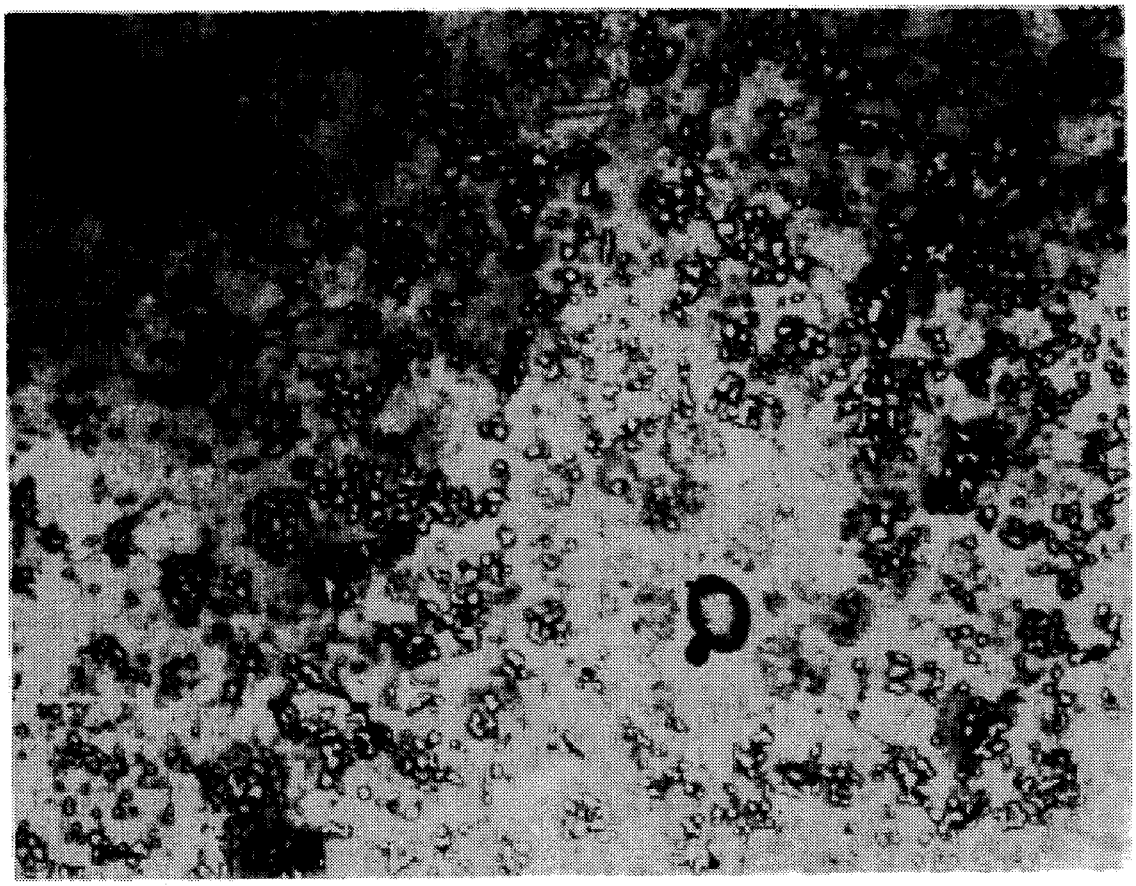
FIG. 9 is a photograph showing a cross-sectional metallic structure of a Ag-Cr electrode containing 10 μm particle size of Cr after sintering.

Then, electrodes were made by the similar process under the similar conditions to the above-mentioned example 2. Results are shown in FIG. 6 (a curve indicated by 10 μm). Contact resistance of the electrodes of Ag-Cr shows lesser increase compared to that of the Cu-Cr electrode even though current breaking is repeatedly performed. FIG. 9 is a microphotograph showing metallic structure of the electrode of the present example.

Figure 10:
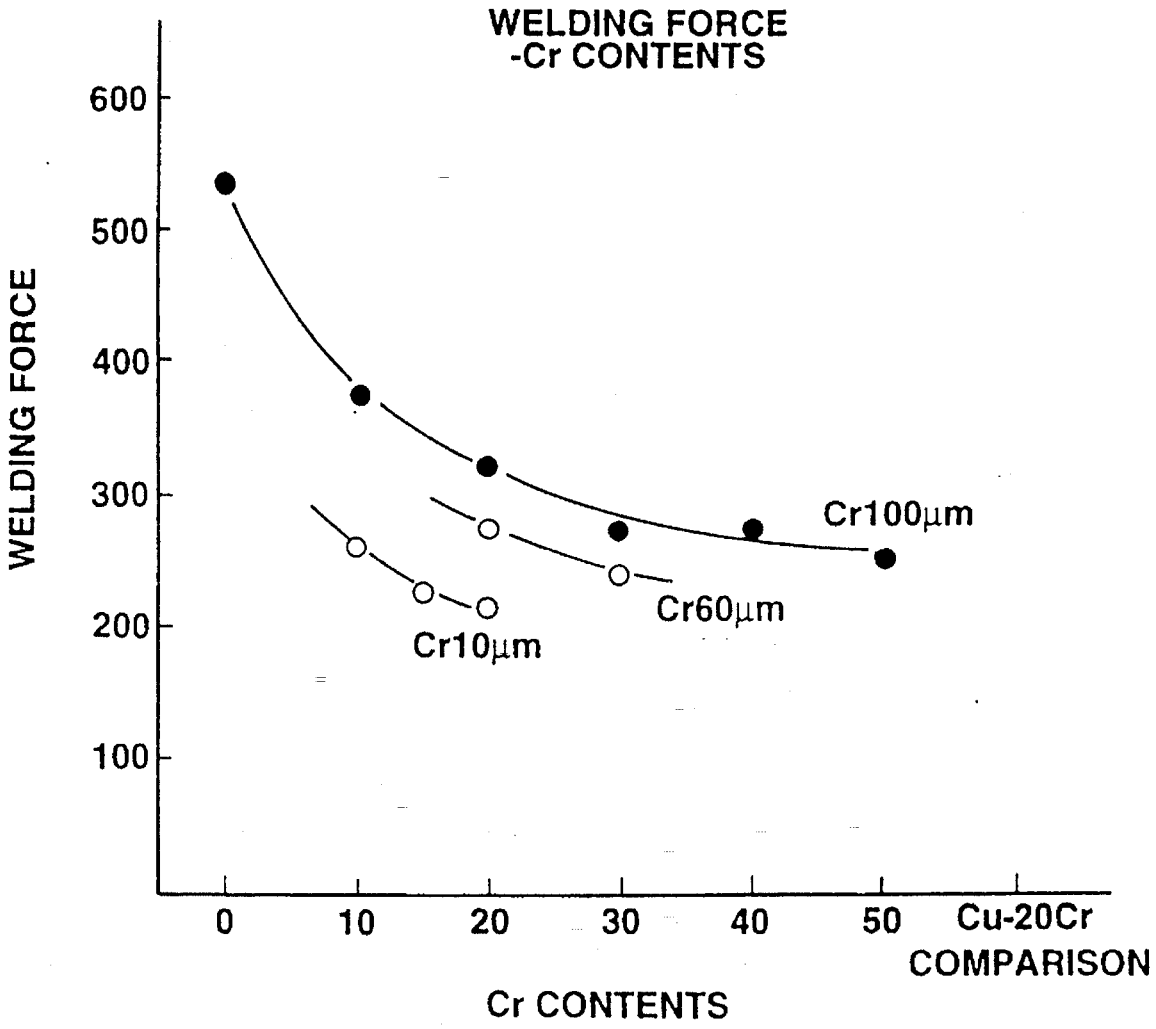
FIG. 10 is a graph showing a relationship between Cr contents and welding force of electrodes containing various particle sizes of Cr.

FIG. 10 shows a relationship between welding force of the electrode of the aforementioned three examples and Cr contents thereof. Welding force of the Cu-Cr electrode is also shown as a comparison.

According to the aforementioned examples, the Ag-Cr electrodes show lesser increase of contact resistance after current breaking. In addition, contact resistance of the electrode does not depend upon Cr particle size contained therein, but increases according to contents of Cr is increased. However, contact resistance of the electrode is not increased by current breaking. Further to say, the Ag-Cr electrode shows excellent welding ability compared to the electrode made of Cu-Cr.

Figure 11:
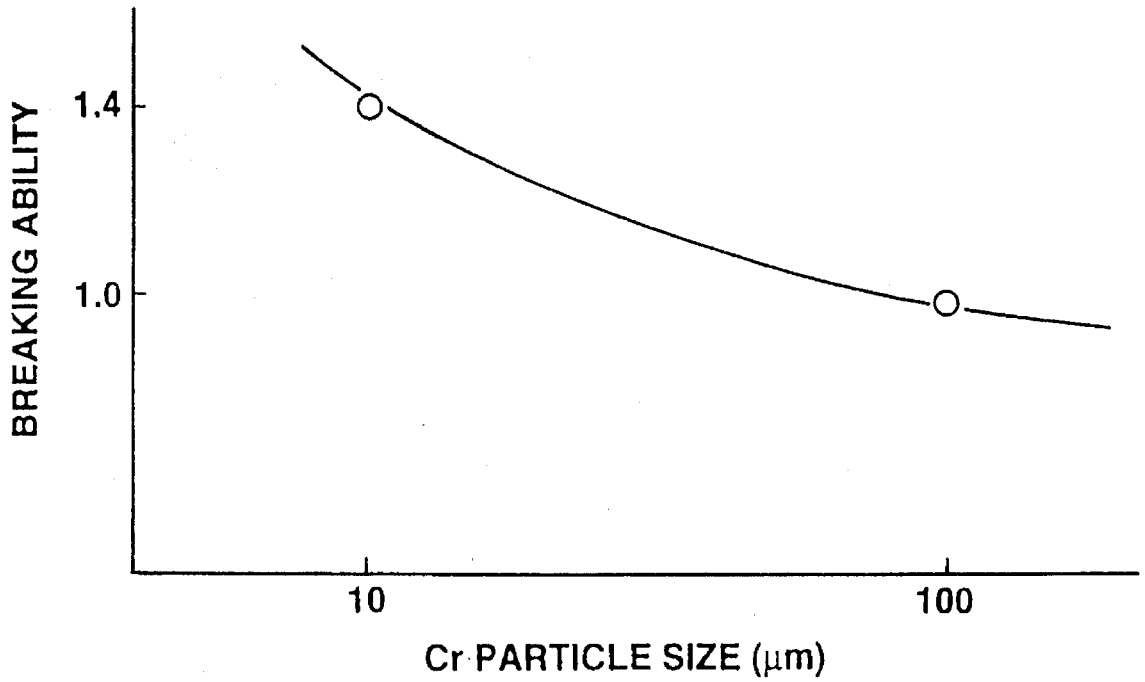
FIG. 11 is a graph showing a relationship between Cr particle size and breaking ability of the electrode.

Generally, current breaking ability of the electrode having smaller particle size of Cr is superior to that having larger one. If Cr particle size becomes larger, ark generated at contact points of Cr and Ag particles tends to be trapped in the Cr particle to prevent smoothly arc migration. On the other hand, if Cr particle size becomes smaller, arc can be rapidly migrated because arc is not trapped in the Cr particle. This allows current breaking to be rapidly performed. FIG. 11 shows a relationship between current breaking ability of the electrode and Cr particle size thereof. Referring to FIGS. 11 and previously referred 10, less than 60 μm of Cr particle size is prefer to maintain breaking ability of the electrode.

Figure 12:
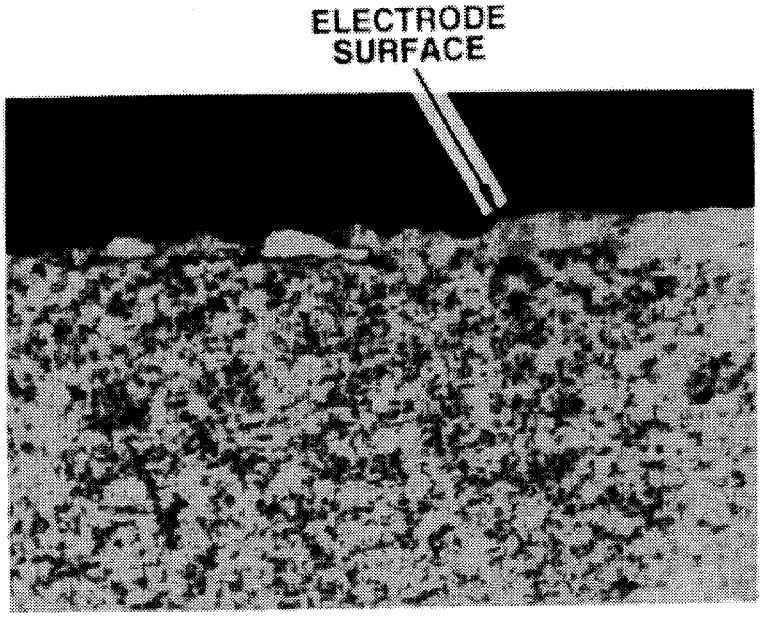
FIG. 12 is a photograph showing a cross-sectional metallic structure of a Ag-Cr electrode containing 10 μm particle size of Cr after current breaking.
Figure 13:
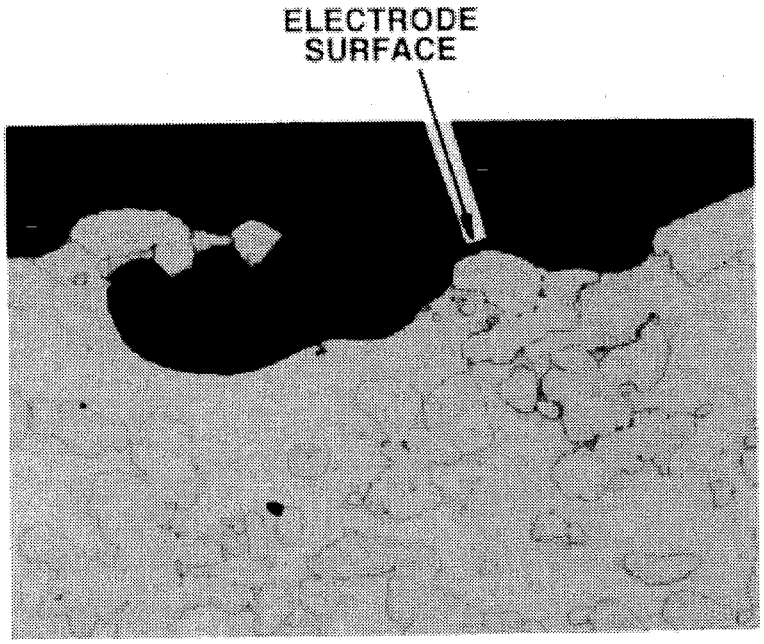
FIG. 13 is a photograph showing a cross-sectional metallic structure of a Ag-Cr electrode containing 100 μm particle size of Cr after current breaking.

FIGS. 12 and 13 are microphotographs showing cross-sectional metallic structures of the electrodes obtained from Examples 4 and 2 after current breaking. Referring to the figures, metallic structure becomes uneven when Cr particle size is larger, therefore, contact portions of Cr and Ag particles are decreased. This causes partial evaporation of Ag or peeling of material from the electrode surface to induce irregularity thereof. On the other hand, if Cr particle size is smaller, any inconveniences as the aforementioned do not occur, therefore, metallic structure adjacent the electrode surface becomes even after current breaking.

Figure 14:
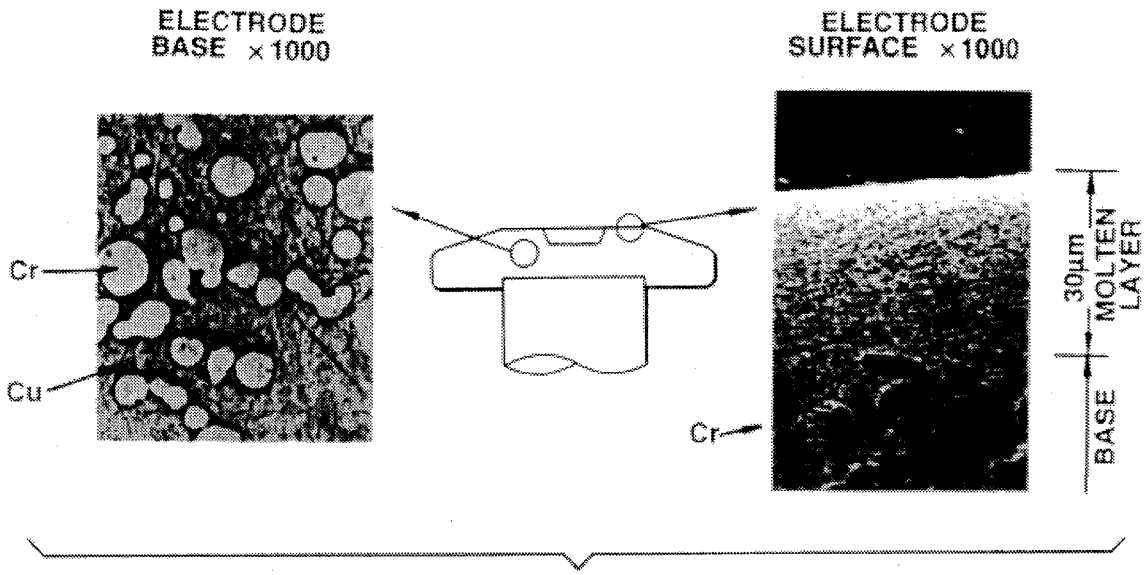
FIG. 14 is a photographic view comparing metallic structures between an electrode base and an electrode surface of a Cu-20 wt. % Cr electrode after current breaking.

FIG. 14 shows metallic structure of the Cu-Cr electrode as a comparison of the Ag-Cr electrode having small Cr particle size which is shown in FIG. 11. A molten layer in which Cr particle having less than 0.5 μm particle size is dispersed is shown adjacent the surface of the Cu-Cr electrode. A liquid phase wherein Cr and Cu particles are evenly dispersed is formed when the electrode is molten by energy of current breaking. The molten layer shown adjacent the electrode surface seems to be formed by immediate cooling of such liquid phase. Thus, hardness of the electrode increases by even dispersion of Cr particles to cause contact resistance of the electrode to be increased.

According to examples 2 to 4, 5 to 50 wt. % of Cr powder having less than 60 μm of particle size and 50 to 95 wt. % of Ag powder are prefer to be blended for the electrode material of the vacuum interrupter. The blended powder is compacted, sintered under the temperature around melting point of Ag. Density of the article is preferably regulated to at least 90%.

Temperature to sinter the compacted body of the electrode material is preferably determined in the range between 800° to 950° C. which are the temperatures around melting point of Ag. When the temperature does not exceed 800° C., sintering of the compacted body cannot be promoted. On the other hand, when that exceeds 950° C., partial melting of the electrode or surface deformation thereof (e.g., blisters) tends to be caused.

Electrode density is required to be more than 90%, because when that does not exceed 90%, conductivity of the electrode is deteriorated. In addition, sintering thereof becomes not sufficient. This causes deterioration of the electrode strength.

Therefore, the vacuum interrupter having lower contact resistance than that using the Cu-Cr electrode can be obtained because the ratio of Ag powder and Cr powder, temperature for sintering, and electrode density are thus specified, contact resistance of the electrode does not increase even though current breaking is repeatedly done.

In addition, the electrode of the present invention shows good breaking ability superior to that of the Ag-WC electrode and low contact resistance compared to that of the Cu-Cr electrode.

Furthermore, the electrode of the present invention shows good welding ability, size of a breaker assembled into the interrupter can be reduced because tripping force applied thereon can be reduced. Therefore, the breaker can be provided at a low cost even though Ag which has been known as a relative expensive material is used for the electrode.

Further to say, when the interrupter is made of the Cu-Cr electrode, principal conductor conventionally occupies large space in the interrupter, furthermore, a fin having good heat radiation is required, these cause size of the interrupter to be enlarged and cost for forming that to be increased. However, when that is made of the electrode material of the present invention, such problems can be solved.

While the present invention has been disclosed in terms of the preferred embodiment in order to facilitate better understanding of the invention, it should be appreciated that the invention can be embodied in various ways without depending from the principle of the invention. Therefore, the invention should be understood to include all possible embodiments and modification to the shown embodiments which can be embodied without departing from the principle of the inventions as set forth in the appended claims.

What is claimed is:

1. A process for forming an electrode material which exhibits reduced contact resistance comprising the steps of;

blending 50 to 95 wt. % of silver(Ag) powder and 5 to 50 wt. % of chromium(Cr) powder, compacting said blended powder to a compacted body, sintering said body at temperatures more than or equal to 800° C. and not to exceed 950° C., and regulating density of the sintered article at least 90%.

2. The process as set forth in claim 1, wherein the particle size of said Cr powder to be blended is less than 150 μ m.

3. The process as set forth in claim 1, wherein the particle size of said Cr powder to be blended is less than 60 μm.

4. The process of claim 1, wherein the particle size of said Ag powder is less than 80 μm.

5. The process of claim 1, wherein the body is sintered under vacuum conditions.

6. The process of claim 1, including the step of providing that said sintered article includes Cr particles dispersed in a silver matrix.

7. The process of claim 1, including the step of forming said article into an electrode.

8. The process of claim 7, including the step of forming said article into a vacuum interrupter.

* * * * *